US012571605B2

(12) United States Patent
Varnum et al.

(10) Patent No.: US 12,571,605 B2
(45) Date of Patent: Mar. 10, 2026

(54) FIREARM SHOOTING REST

(71) Applicant: AOB Products Company, Columbia, MO (US)

(72) Inventors: Ryan Varnum, Columbia, MO (US); Timothy S. Kinney, Warrenton, MO (US); Jason Nickerson, Columbia, MO (US); Seth Wheeler, Columbia, MO (US); Todd Strobel, Columbia, MO (US); Michael Lindsay, Columbia, MO (US); Matthew Kinamore, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 18/778,424

(22) Filed: Jul. 19, 2024

(65) Prior Publication Data

US 2025/0027737 A1 Jan. 23, 2025

Related U.S. Application Data

(60) Provisional application No. 63/514,422, filed on Jul. 19, 2023.

(51) Int. Cl.
*F41A 23/14* (2006.01)

(52) U.S. Cl.
CPC ..... *F41A 23/14* (2013.01)

(58) Field of Classification Search
CPC ..... F41A 23/14; F41A 23/02; F41A 23/005; F41A 23/06; F41A 23/16
See application file for complete search history.

(56) References Cited

U.S. PATENT DOCUMENTS

| | | | |
|---|---|---|---|
| 1,361,577 | A | 12/1920 | Harbord |
| 1,473,946 | A | 11/1923 | Amsden et al. |
| 2,870,683 | A | 1/1959 | Wilson |
| 4,007,554 | A | 2/1977 | Helmstadter |
| 4,265,045 | A | 5/1981 | Garbini |
| 4,333,385 | A | 6/1982 | Culver |
| 4,548,392 | A | 10/1985 | Rickling |
| 4,819,359 | A | 4/1989 | Bassett |
| 4,824,086 | A | 4/1989 | Rickling et al. |
| 4,841,839 | A | 6/1989 | Stuart |
| 5,081,782 | A | 1/1992 | Wright |
| 5,794,899 | A | 8/1998 | Tamllos |
| 5,811,720 | A | 9/1998 | Quinnell et al. |
| 5,937,561 | A | 8/1999 | Abernethy |
| 6,293,041 | B2 | 9/2001 | Weaver |

(Continued)

OTHER PUBLICATIONS

RRS SOAR VYCE, "VYCE Equipment Support Mount: VYCE with OR Plate," http://rrssoar.com/vyce, 7 pgs. [as early as 2018].

(Continued)

*Primary Examiner* — J. Woodrow Eldred
(74) *Attorney, Agent, or Firm* — Stinson LLP

(57) ABSTRACT

A weapon support and associated components and methods. The weapon support includes a frame including one or more legs, and the weapon support includes a weapon support head supported by the frame. The weapon support head includes a cradle including first and second jaws configured to selectively clamp the weapon. The cradle can be pivoted relative to the frame to adjust an aim of the weapon relative to the frame.

32 Claims, 4 Drawing Sheets

(56) References Cited

U.S. PATENT DOCUMENTS

| | | | |
|---|---|---|---|
| 6,526,687 | B1 | 3/2003 | Looney |
| 6,877,266 | B1 | 4/2005 | Brownlee |
| 7,356,960 | B1 | 4/2008 | Knitt |
| 7,549,247 | B1 | 6/2009 | Reese |
| 7,584,690 | B2 | 9/2009 | Cauley |
| 7,744,048 | B1 | 6/2010 | McKellery et al. |
| 7,823,317 | B2 | 11/2010 | Potterfield et al. |
| 8,083,198 | B2 | 12/2011 | Stabler |
| 8,251,330 | B2 | 8/2012 | Stabler |
| 8,302,228 | B2 | 11/2012 | Aboujaoude |
| 8,893,897 | B2 | 11/2014 | Workman et al. |
| 8,894,024 | B2 | 11/2014 | Deros |
| 8,905,391 | B2 | 12/2014 | Weissenborn |
| 9,151,561 | B2 | 10/2015 | Morrow et al. |
| 9,206,941 | B2 | 12/2015 | Smith et al. |
| 9,695,977 | B2 | 7/2017 | Blalock et al. |
| 10,288,987 | B2 | 5/2019 | Olmos-Calderon |
| 10,436,537 | B2 | 10/2019 | Fudala et al. |
| 10,514,225 | B2 | 12/2019 | Cauley, Jr. et al. |
| 10,724,557 | B2 | 7/2020 | Banes et al. |
| 11,009,306 | B2 | 5/2021 | Cauley, Jr. et al. |
| 11,383,355 | B2 | 7/2022 | Graham et al. |
| 11,656,052 | B2 | 5/2023 | Kimmel et al. |
| 2005/0098692 | A1 | 5/2005 | Yang |
| 2008/0178641 | A1 | 7/2008 | Himmen |
| 2010/0102178 | A1 | 4/2010 | Smith et al. |
| 2019/0219353 | A1* | 7/2019 | Cauley, Jr. ..... F41A 23/14 |
| 2021/0180742 | A1 | 6/2021 | Steere et al. |
| 2023/0184372 | A1 | 6/2023 | Thomason et al. |

OTHER PUBLICATIONS

HOG Saddle, "HOG Saddle® MOD 7," http://stores.hogsaddle.com/hog-saddle-mod-7/, 5 pgs. [as early as 2018].

RRS, "Really Right Stuff VYCE Equipment Support Mount Direct Thread B&H," https://www.bhphotovideo.com/c/product,/1344804-REG/really_right_stuff_vyce_direct_thread_vyce_equipment_support_mount.html, 3 pgs. [Internet accessed Jul. 26, 2023].

* cited by examiner

FIREARM SHOOTING REST

CROSS-REFERENCE TO RELATED APPLICATION

The present application claims priority to U.S. Provisional Patent App. No. 63/514,422, filed Jul. 19, 2023, which is hereby incorporated by reference in its entirety.

FIELD

The present disclosure generally relates to equipment supports, and more particularly to stands such as monopods, bipods, tripods, etc., for supporting equipment such as weapons, optics, cameras, or other equipment.

BACKGROUND

Monopods, bipods, tripods, and other types of equipment stands are used to support various types of equipment. For example, hunters may use such stands to support an optic (e.g., spotting scope), a weapon (e.g., rifle), or a camera. Such equipment supports are also used in other activities.

SUMMARY

In one aspect, a weapon support head for supporting a weapon comprises a base defining a bed configured to support the weapon. The weapon support head comprises first and second jaws supported by the base and extending upward relative to the bed. The first and second jaws are moveable relative to the base to change a distance between the jaws to clamp the weapon between the jaws. A first jaw guide extends from the first jaw to the base and is configured to guide movement of the first jaw relative to the base. A first second jaw guide extends from the second jaw to the base and is configured to guide movement of the second jaw relative to the base. A jaw driver supported by the base is configured to move the first and second jaws toward and away from each other relative to the base. The jaw driver is between the first jaw guide and the first second jaw guide.

In another aspect, a weapon support head for supporting a weapon comprises a base defining a bed configured to support the weapon. The weapon support head includes first and second jaws supported by the base and extending upward relative to the bed. The first jaw is moveable relative to the base to change a distance between the first and second jaws to clamp the weapon between the jaws. A jaw driver is supported by the base and configured to move the first jaw outward and inward relative to the base. A first jaw guide extends from the first jaw to the base and is configured to guide movement of the first jaw relative to the base. The first jaw guide includes a stop configured to stop outward movement of the first jaw relative to the base.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
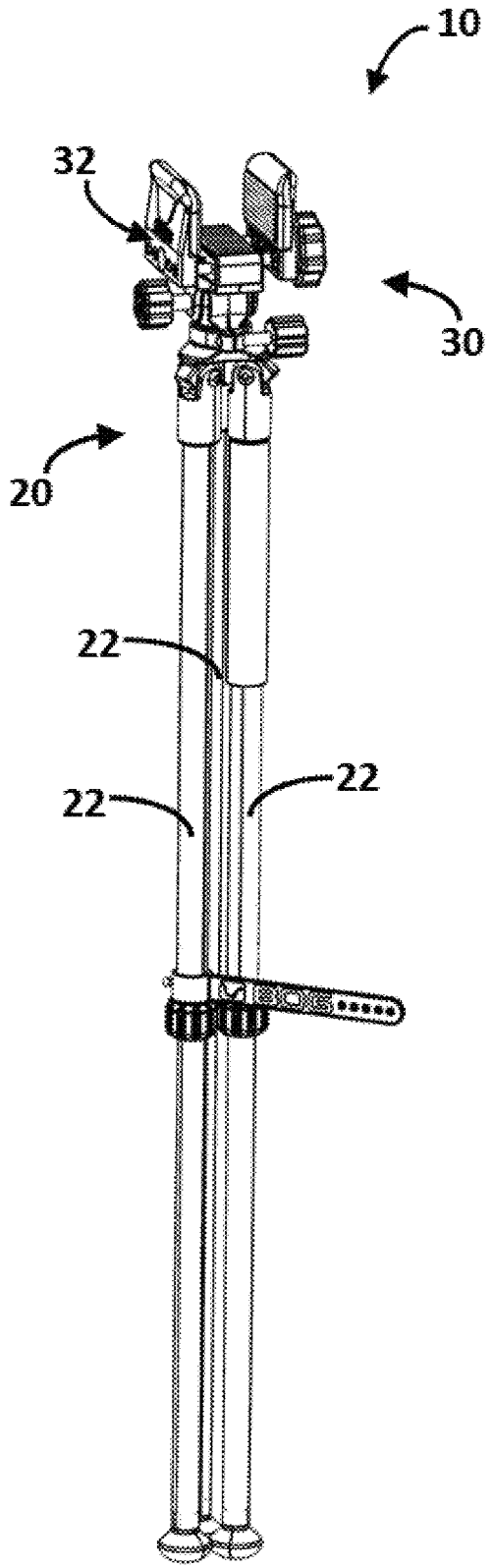
FIG. 1 is a perspective of a weapon support of the present disclosure.

Referring to FIG. 1, a weapon support of the present disclosure is indicated generally by the reference number 10. The weapon support 10 may be used to support a variety of weapons, such as firearms (e.g., rifle, shotgun, etc.) or crossbows. The weapon support 10 may assist the shooter in maintaining the weapon in a stable position to facilitate aiming of the weapon at a desired target.

The weapon support 10 includes a frame 20 comprising three extendable legs 22 and a leg mount 24. The three legs are connected to the leg mount and are pivotable between stowed positions (e.g., FIG. 1) and deployed positions (not shown) with respect to the leg mount. The illustrated frame 20 is a tripod with three legs 22, but it will be appreciated weapon supports according to the present disclosure could have other types of frames, such as other numbers of legs (e.g., two, one, none), without departing from the scope of the present disclosure.

Figure 2:
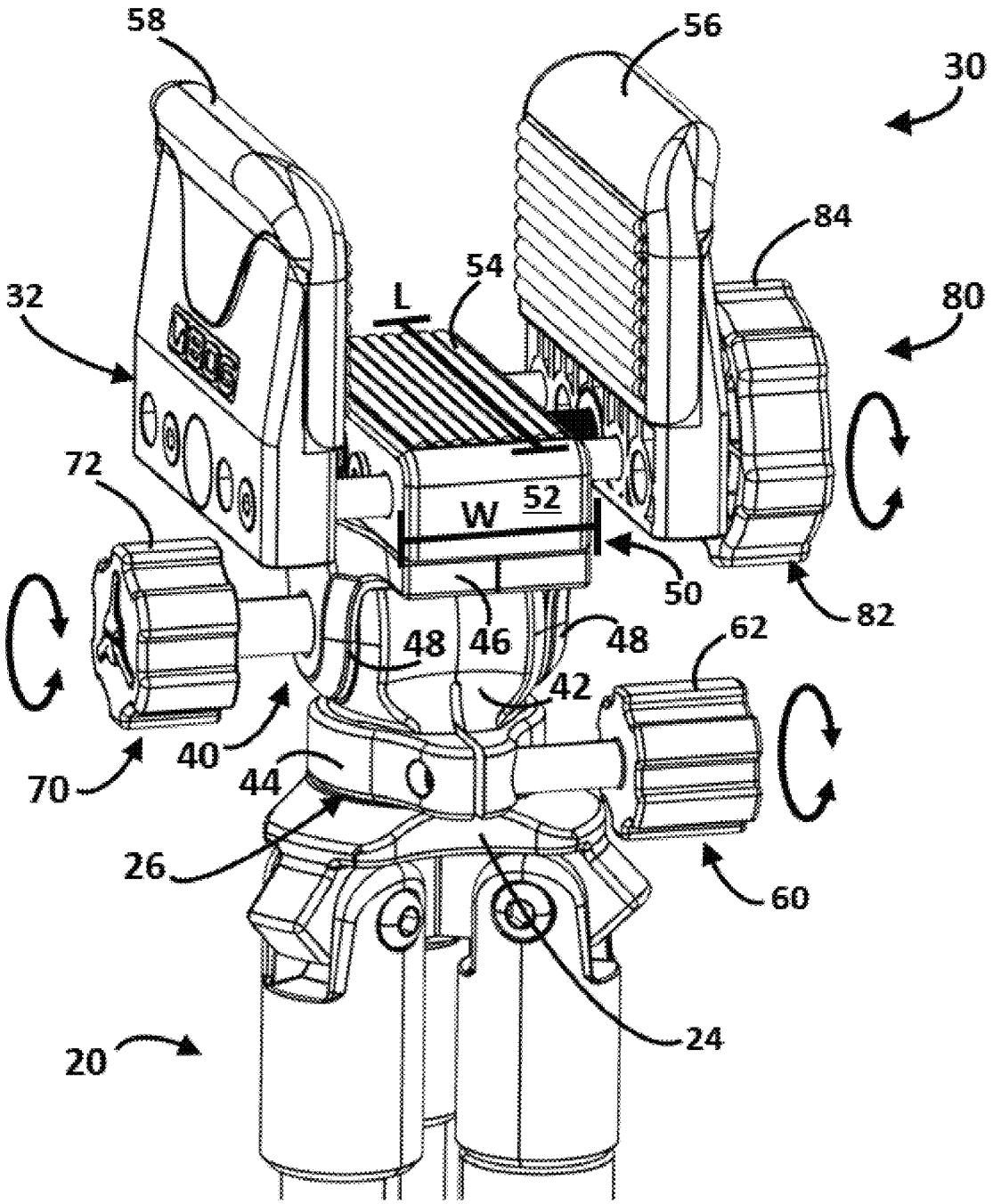
FIG. 2 is a fragmentary perspective of the weapon support.

Referring to FIG. 2, the weapon support 10 includes a support head 30 (e.g., tripod head) including a cradle 32 configured to engage the weapon (not shown) to support the weapon. The support head 30 includes a stem 40, a base 50, and first and second jaws 56, 58. The base 50 defines a bed 52 having a weapon support surface 54 that supports the weapon when the weapon is between the first and second jaws 56, 58. The bed has a length L extending between forward and rear ends of the cradle. The bed has a width W extending widthwise of the cradle between the jaws. The first and second jaws 56, 58 are located outboard of the bed 52 and extend upward relative to the bed. In the illustrated embodiment, both jaws 56, 58 are moveable with respect to the bed 52 to change a distance between the jaws. The jaws 56, 58 can be moved inward and outward, as described in greater detail below, to selectively clamp and unclamp the weapon in the cradle 32. Other configurations can be used without departing from the scope of the present disclosure.

The stem 40 includes a hub 42 and a yoke 44. The hub 42 is received on a boss portion 26 extending upward from the leg mount 24. The hub 42 is pivotable about the boss portion 26 to permit the user to adjust a horizontal aim of the weapon. A yaw actuator 60 is provided to permit the user to selectively permit horizontal aim adjustment. The yaw actuator 60 comprises a knob 62 connected to a collar of the hub. Rotation of the yaw 60 actuator in a first direction loosens the collar to increase freedom of pivoting of the cradle 32 about the stem 40. Rotation of the yaw actuator 60 in a second direction opposite the first direction tightens the collar on the boss portion 26 to restrict pivoting about the boss portion. The collar 44 can be tightened on the boss portion 26 sufficiently to create a friction lock that prevents pivoting of the cradle 32 about the boss portion. The yoke 46 is pivotable with respect to the hub 42 to permit the user to change vertical aim of the weapon in the cradle 32. The yoke 46 includes two arms 48 on opposite sides of the hub 42. A pitch actuator 70 is provided to permit the user to selectively permit vertical aim adjustment. The pitch actuator 70 comprises a knob 72 connected to the two arms 48. Rotation of the pitch actuator 70 in a first direction loosens the arms 48 relative to the hub 42 to permit more freedom in pivoting of the yoke 46. Rotation of the pitch actuator 70 in an opposite second direction tightens the arms 48 relative to the hub 42 and can create a friction lock to lock a vertical aim of the weapon in the cradle 32. Other configurations can be used without departing from the scope of the present disclosure.

The cradle 32 includes a jaw driver 80 configured to change the distance between the first and second jaws 56, 58 for selectively clamping the weapon with the jaws. The jaw driver 80 includes a jaw actuator 82 and a threaded shaft assembly 90 including a first shaft 92 and a second shaft 100. The jaw actuator 82 comprises a knob 84 secured to the first shaft 92 to rotate conjointly with the first shaft. The first shaft 92 is received in a bushing 88 (e.g., bearing) in the first jaw 56. The first jaw 56 is captured between a shoulder 94 of the first shaft 92 and a lip 86 of the jaw actuator 82 to prevent translation of the first shaft and knob 84 relative to the first jaw. However, the first shaft 92 and knob 84 are permitted to rotate relative to the first jaw 56 via the bushing 88. The second shaft 100 is secured to the second jaw 58 and does not rotate or translate relative to the second jaw. The first shaft 92 includes a female threaded section 96 (first threaded section) that is in threaded engagement with a male threaded section 102 (second threaded section) of the second shaft 100. The first shaft 92 includes a male threaded section 98 (third threaded section) that is received in a female threaded passage 106 (fourth threaded section) of the bed 52. In the illustrated embodiment, the threaded passage 106 of the bed 52 is formed by a threaded insert 104 (e.g., shaft) formed separately from and mounted in a body of the bed. In use, rotation of the jaw actuator 82 causes rotation of the first shaft 92 relative to the first jaw 56, the second shaft 100, and the threaded bed passage 106. Depending on the direction the jaw actuator 82 is rotated, the jaws 56, 58 move inward together toward each other or outward together away from each other. The external threads 98 of the first shaft are right-handed. The internal threads 96 of the first shaft 92 are left-handed and are two times the pitch of the external threads 98 of the first shaft. This arrangement results in the first and second jaws 56, 58 moving inward and outward relative to the bed 52 at the same time, same speed, and same distance. This keeps the bed 52 at the midpoint between the jaws regardless of how much the jaw actuator 82 is turned. Cradles having other configurations (e.g., one moveable jaw and one static jaw) can be used without departing from the scope of the present disclosure.

Movement of the jaws relative to the bed is guided by respective sets of jaw guides. In the illustrated embodiment, the guides 110, 120, 130, 140 comprise slides in the form of rods. First and second first jaw guides 110, 120 extend from the first jaw 56 through passages in the bed 52, and first and second jaw guides 130, 140 extend from the second jaw 58 through additional passages in the bed. The proximal ends 112, 122 of the first jaw guides 110, 120 are secured to the first jaw 56 to cause conjoint movement of the first jaw guides and first jaw relative to the bed 52. The proximal ends 132, 142 of the second jaw guides 130, 140 are secured to the second jaw 58 to cause conjoint movement of the second jaw guides and second jaw relative to the bed 52. The first jaw 56 includes guide receivers 134, 144 configured to receive the distal ends 136, 146 of the second jaw guides 130, 140, and the second jaw 58 includes guide receivers 114, 124 configured to receive the distal ends 116, 126 of the first jaw guides 110, 120. The guide receivers permit the jaws to be moved toward each other without the distal ends of the guides impeding inward movement of the jaws. Other configurations can be used without departing from the scope of the present disclosure.

Figure 3:
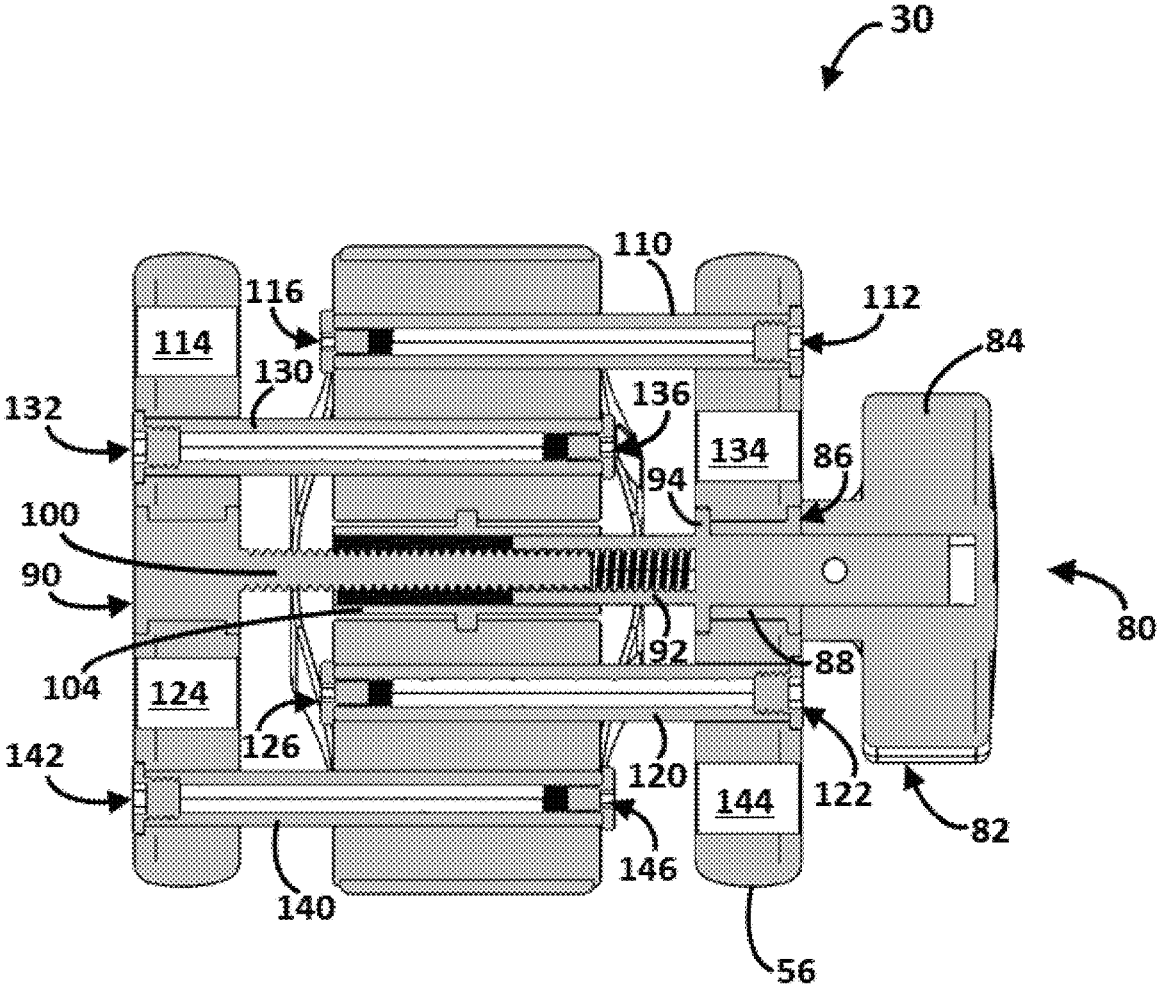
FIG. 3 is a section of the weapon support taken in a plane extending widthwise of the weapon support.
Figure 4:
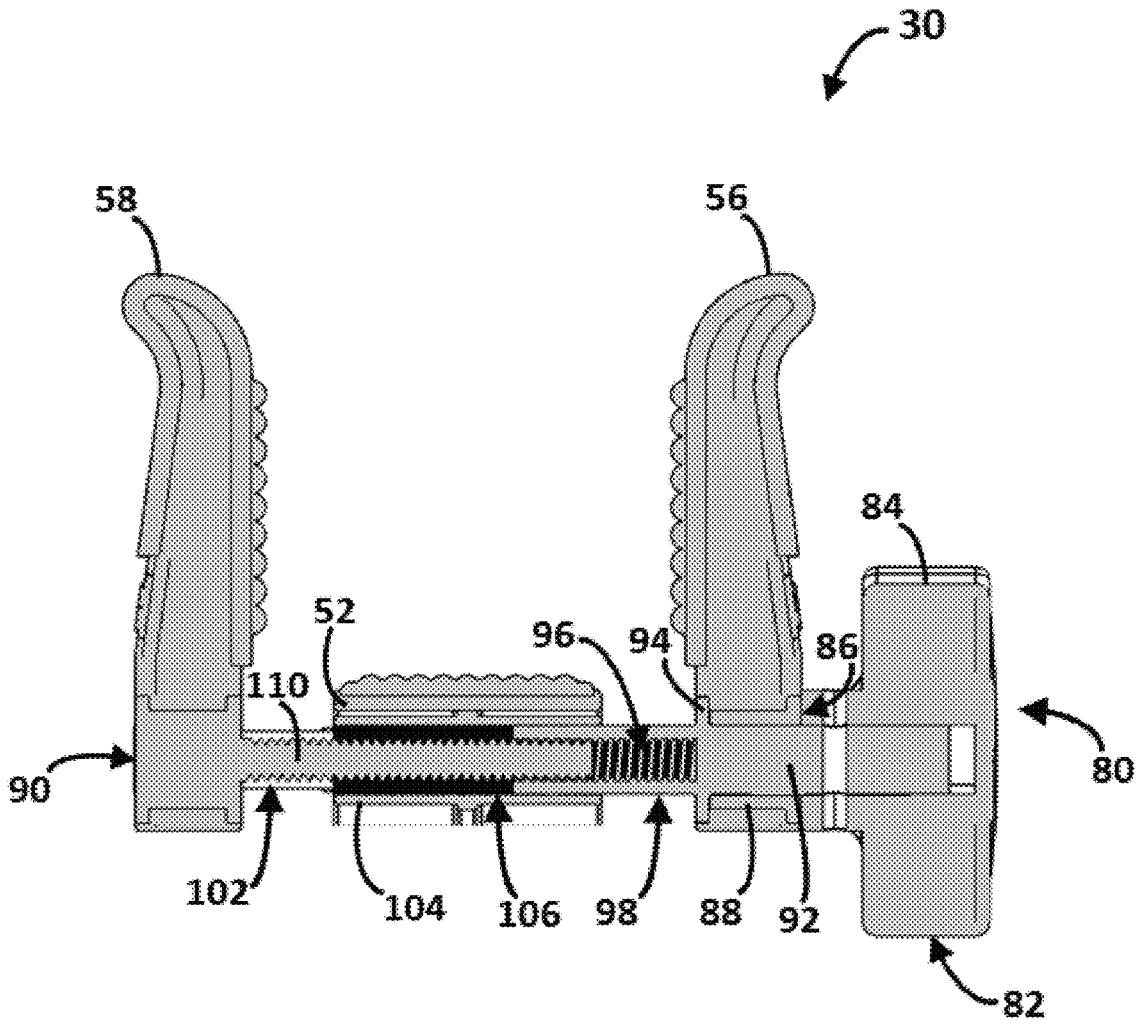
FIG. 4 is a section of a cradle of the weapon support taken in a plane extending heightwise of the cradle.

It will be appreciated that the cradle 32 is configured to be relatively compact. The jaw driver 80 (e.g., the first and second shafts) is located between the first jaw guides 110, 120 and between the second jaw guides 130, 140. The arrangement is such that the jaw driver 80 (e.g., the first and second shafts) and the first and second jaw guides are intersected by a plane (e.g., the plane in which the section of FIG. 3 is taken) below the weapon support surface 54 of the bed 52. Moreover, the jaw actuator is configured to move inward with the first jaw to decrease the footprint of the cradle when the jaws are moved toward each other. Other configurations can be used without departing from the scope of the present disclosure.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

What is claimed is:

1. A weapon support head for supporting a weapon, the weapon support head comprising:

a base defining a bed configured to support the weapon;

first and second jaws supported by the base and extending upward relative to the bed, the first and second jaws being moveable relative to the base to change a distance between the first and second jaws to clamp the weapon between the first and second jaws, the first and second jaws each having an inner side, the inner sides of the first and second jaws facing one another;

a first guide extending from the inner side of the first jaw to the base and configured to guide movement of the first jaw relative to the base, the first guide being moveable relative to the base with the first jaw as the first jaw moves relative to the base;

a second guide extending inwardly from the inner side of the second jaw to the base and configured to guide movement of the second jaw relative to the base, the second guide being moveable relative to the base with the second jaw as the second jaw moves relative to the base; and a jaw driver supported by the base and configured to move the first and second jaws toward and away from each other relative to the base, the jaw driver being disposed between the first guide and the second guide.

2. The weapon support head as set forth in claim 1, further comprising a third guide extending from the first jaw to the base and configured to guide movement of the first jaw relative to the base.

3. The weapon support head as set forth in claim 2, wherein the jaw driver is disposed between the first guide and the third guide.

4. The weapon support head as set forth in claim 3, further comprising a fourth guide extending from the second jaw to the base and configured to guide movement of the second jaw relative to the base.

5. The weapon support head as set forth in claim 4, wherein the jaw driver is disposed between the second guide and the fourth guide.

6. The weapon support head as set forth in claim 5, wherein the bed defines a support surface configured to support the weapon when the weapon is between the jaws, and wherein a plane below the support surface intersects the jaw driver, the first guide, the second guide, the third guide, and the fourth guide.

7. The weapon support head as set forth in claim 1, wherein the bed defines a support surface configured to support the weapon when the weapon is between the jaws, and wherein a plane below and parallel to the support surface intersects the jaw driver and the first guide and the second guide.

8. The weapon support head as set forth in claim 1, further comprising a yaw actuator configured to selectively permit pivoting of the base to adjust a horizontal aim of the weapon.

9. The weapon support head as set forth in claim 1, further comprising a pitch actuator configured to selectively permit pivoting of the base to adjust a vertical aim of the weapon.

10. The weapon support head as set forth in claim 1, wherein the first guide includes a stop configured to stop outward movement of the first jaw relative to the bed.

11. The weapon support head as set forth in claim 1, wherein the jaw driver comprises a threaded shaft assembly including a first threaded shaft and a second threaded shaft in threaded engagement with the first threaded shaft, the threaded shaft assembly being disposed between the first guide and the second guide.

12. The weapon support head as set forth in claim 1, further comprising a frame including multiple legs, the frame being coupled to the weapon support head, the legs being configured to support the weapon support head, the legs being pivotable between stowed and deployed positions.

13. The weapon support head as set forth in claim 1, wherein the first guide extends in a first inward direction from the inner side of the first jaw to the base and the second guide extends in a second inward direction from the inner side of the second jaw to the base, the first inward direction being towards the second jaw and the second inward direction being towards the first jaw.

14. The weapon support head as set forth in claim 1, wherein the first guide comprises a first rod and the second guide comprises a second rod.

15. The weapon support head as set forth in claim 14, wherein the first and second rods are configured to slide along the base as the first and second jaws move relative to the base.

16. The weapon support head as set forth in claim 15, wherein the base includes a first passage and a second passage, the first rod being disposed in and moveable along the first passage and the second rod being disposed in and moveable along the second passage.

17. The weapon support head as set forth in claim 16, wherein the base has a first side and an opposite second side, the first and second passages each extending through the base from the first side to the second side.

18. The weapon support head as set forth in claim 16, wherein the first rod extends through the first passage and the second rod extends through the second passage.

19. The weapon support head as set forth in claim 1, wherein the first jaw includes a first receiver configured to receive an end portion of the second guide and the second jaw includes a second receiver configured to receive an end portion of the first guide.

20. The weapon support head as set forth in claim 19, wherein the first receiver comprises an opening and the second receiver comprises an opening.

21. The weapon support head as set forth in claim 1, further comprising:

a third guide extending from the inner side of the first jaw to the base and configured to guide movement of the first jaw relative to the base, the third guide being moveable relative to the base with the first jaw as the first jaw moves relative to the base; and a fourth guide extending from the inner side of the second jaw to the base and configured to guide movement of the second jaw relative to the base, the fourth guide being moveable relative to the base with the second jaw as the second jaw move relative to the base.

22. The weapon support head as set forth in claim 21, wherein the first and third guides extend in a first inward direction from the inner side of the first jaw to the base, wherein the second and fourth guides extends in a second inward direction from the inner side of the second jaw to the base, the first inward direction being towards the second jaw and the second inward direction being towards the first jaw.

23. The weapon support head as set forth in claim 22, wherein the first guide comprises a first rod, the second guide comprises a second rod, the third guide comprises a third rod, and the fourth guide comprises a fourth rod.

24. The weapon support head as set forth in claim 23, wherein the first, second, third, and fourth rods are configured to slide along the base as the first and second jaws move relative to the base.

25. The weapon support head as set forth in claim 24, wherein the base includes a first passage, a second passage, a third passage, and a fourth passage, the first rod being disposed in and moveable along the first passage, the second rod being disposed in and moveable along the second passage, the third rod being disposed in and moveable along the third passage, and the fourth rod being disposed in and moveable along the fourth passage.

26. The weapon support head as set forth in claim 25, wherein the base has a first side and an opposite second side, the first, second, third, and fourth passages each extending through the base from the first side to the second side.

27. The weapon support head as set forth in claim 26, wherein the first rod extends through the first passage, the second rod extends through the second passage, the third rod extends through the third passage, and the fourth rod extends through the fourth passage.

28. The weapon support head as set forth in claim 21, wherein the second guide is disposed between the first guide and the third guide, and the third guide is disposed between the second guide and the fourth guide.

29. The weapon support head as set forth in claim 28, wherein the jaw driver is disposed between the second guide and the third guide.

30. The weapon support head as set forth in claim 29, wherein a plane intersects the jaw driver, the first guide, the second guide, the third guide, and the fourth guide.

31. The weapon support head as set forth in claim 30, wherein the base includes a first passage, a second passage, a third passage, and a fourth passage, the first guide being disposed in and moveable along the first passage, the second guide being disposed in and moveable along the second passage, the third guide being disposed in and moveable along the third passage, and the fourth guide being disposed in and moveable along the fourth passage.

32. The weapon support head as set forth in claim 31, wherein the base has a first side and an opposite second side, the first, second, third, and fourth passages each extending through the base from the first side to the second side.

* * * * *